US009857768B2

(12) United States Patent
Fukuma et al.

(10) Patent No.: US 9,857,768 B2
(45) Date of Patent: Jan. 2, 2018

(54) IMAGE FORMING APPARATUS OPERABLE WITH REGULAR TONER CONTAINER PROPERLY MOUNTED

(71) Applicant: Kyocera Document Solutions Inc., Osaka (JP)

(72) Inventors: Nobuhiro Fukuma, Osaka (JP); Daisuke Fujiwara, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/338,432

(22) Filed: Oct. 30, 2016

(65) Prior Publication Data

US 2017/0123343 A1 May 4, 2017

(30) Foreign Application Priority Data

Oct. 30, 2015 (JP) ..... 2015-214679

(51) Int. Cl.

| | |
|---|---|
| ***G03G 15/00*** | (2006.01) |
| ***G03G 21/18*** | (2006.01) |
| ***G03G 15/08*** | (2006.01) |
| ***G03G 21/16*** | (2006.01) |

(52) U.S. Cl.

CPC ..... *G03G 21/1896* (2013.01); *G03G 15/0863* (2013.01); *G03G 21/1647* (2013.01); *G03G 2215/0695* (2013.01); *G03G 2221/1654* (2013.01); *G03G 2221/1892* (2013.01)

(58) Field of Classification Search

CPC ..... G03G 15/0832; G03G 15/0863; G03G 15/0865; G03G 21/1633; G03G 21/1642; G03G 21/1647; G03G 21/1875; G03G 21/1869; G03G 2215/0695; G03G 2221/1651; G03G 2221/1654; G03G 2221/1892

USPC ..... 399/12, 13, 111, 262

See application file for complete search history.

(56) References Cited

U.S. PATENT DOCUMENTS

| | | | | |
|---|---|---|---|---|
| 6,347,195 | B1 * | 2/2002 | Saiki | B41J 2/17503 399/12 |
| 2013/0243445 | A1 * | 9/2013 | Takahira | G03G 15/0898 399/13 |
| 2016/0103416 | A1 * | 4/2016 | Eto | G03G 21/1676 399/119 |

FOREIGN PATENT DOCUMENTS

| | | |
|---|---|---|
| JP | 2001-042619 A | 2/2001 |
| JP | 2007-309991 A | 11/2007 |

* cited by examiner

*Primary Examiner* — Benjamin Schmitt
(74) *Attorney, Agent, or Firm* — James Judge

(57) ABSTRACT

An image forming apparatus includes an image forming unit, a mounting portion, and a detecting device. The image forming unit forms an image using toner. A toner container of a given type is removably mounted on the mounting portion. The detecting device detects whether or not the toner container has been mounted on the mounting portion. The toner container and the mounting portion respectively include an engaging protrusion and an engaging hole. The engaging protrusion and the engaging hole are engageable with one another. The engaging protrusion and the engaging hole engaged with one another causes the detecting device to detect that the toner container has been mounted on the mounting portion. The engaging protrusion and the engaging hole are of form configured according to the toner container type.

3 Claims, 14 Drawing Sheets

IMAGE FORMING APPARATUS OPERABLE WITH REGULAR TONER CONTAINER PROPERLY MOUNTED

INCORPORATION BY REFERENCE

This application is based upon, and claims the benefit of priority from, corresponding Japanese Patent Application No. 2015-214679 filed in the Japan Patent Office on Oct. 30, 2015, the entire contents of which are incorporated herein by reference.

BACKGROUND

Unless otherwise indicated herein, the description in this section is not prior art to the claims in this application and is not admitted to be prior art by inclusion in this section.

At a typical electrophotographic-method image forming apparatus, an electrostatic latent image formed on an image carrier is developed to a toner image by a developing device. When an amount of a toner in the developing device becomes a predetermined amount or less, the toner is replenished from a toner container to the developing device.

The toner container is attached and removed to/from a mounting portion through an opening formed at the image forming apparatus. The opening is openable/closable by a cover. It is detected that the image forming apparatus is in an operable state such that the toner container is normally mounted to close the cover. If it is misdetected that the image forming apparatus is in the operable state when the toner container is not normally mounted on the mounting portion, a failure such as a printing failure occurs.

In order to prevent such misdetection, a following image forming apparatus is proposed; in the image forming apparatus, a toner container includes a lever and the lever is rotated after mounting the toner container on the mounting portion, such that normal mounting of the toner container can be detected and the cover can be closed, in other words, configured such that the cover cannot be closed unless the toner container is normally mounted.

SUMMARY

An image forming apparatus according to one aspect of the disclosure includes an image forming unit, a mounting portion, and a detecting device. The image forming unit forms an image using toner. A toner container of a given type is removably mounted on the mounting portion. The detecting device detects whether or not the toner container has been mounted on the mounting portion. The toner container and the mounting portion respectively include an engaging protrusion and an engaging hole. The engaging protrusion and the engaging hole are engageable with one another. The engaging protrusion and the engaging hole engaged with one another causes the detecting device to detect that the toner container has been mounted on the mounting portion. The engaging protrusion and the engaging hole are of form configured according to the toner container type.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

FIG. 4A is a perspective view viewed from a front side of the toner container, and FIG. 4B is a perspective view viewed from a back side of the toner container.

FIG. 5A illustrates a state where a regulating member does not turn (an initial position), and FIG. 5B illustrates a state where the regulating member turns (a turned position).

FIG. 9A is a perspective view viewed from a left side, and FIG. 9B is a perspective view viewed from a right side.

FIG. 10A is an exploded perspective view viewed from a left side, and FIG. 10B is an exploded perspective view viewed from a right side.

DETAILED DESCRIPTION

Figure 1:
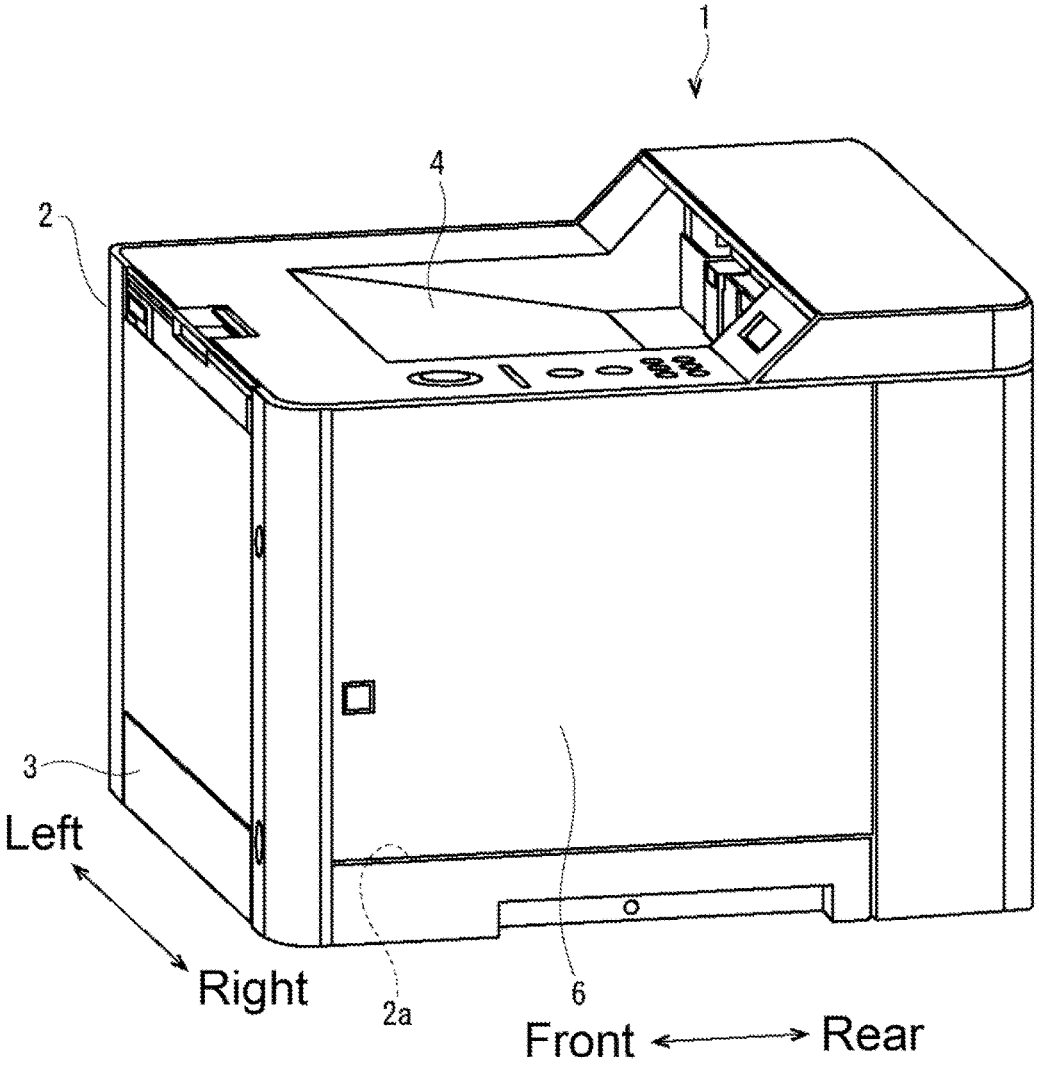
FIG. 1 obliquely illustrates a color printer according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an image forming apparatus according to one embodiment of the disclosure with reference to the accompanying drawings.

A description will be given of a color printer 1 as the image forming apparatus with reference to FIGS. 1 to 3.

FIG. 1 obliquely illustrates a color printer. FIG. 2 obliquely illustrates the color printer where a toner-container-attaching/removing opening is opened. FIG. 3 obliquely illustrates the toner-container-attaching/removing opening. The following describes assuming that a front-rear direction illustrated in FIG. 1 is a front-rear direction of the color printer, and a right-left direction is a direction where the color printer is viewed from a front side.

As illustrated in FIG. 1, the color printer 1 includes an apparatus main body 2 having an approximately rectangular box shape. The apparatus main body 2 has a lower portion where a sheet feed cassette 3 is mounted. The apparatus main body 2 has a top surface where a discharge tray 4 is located. An image forming unit, a conveying path of paper sheets, and a control unit are located inside the apparatus main body 2. The image forming unit performs an image formation in an electrophotographic method using four color toners. The conveying path of paper sheets heads for the discharge tray 4 from the sheet feed cassette 3 through the image forming unit. The control unit controls an image forming operation. The control unit controls such that a paper sheet is fed from the sheet feed cassette 3, then the paper sheet is conveyed along the conveying path, then an image is formed on the paper sheet at the image forming unit, and then the paper sheet is discharged to the discharge tray 4.

Figure 2:
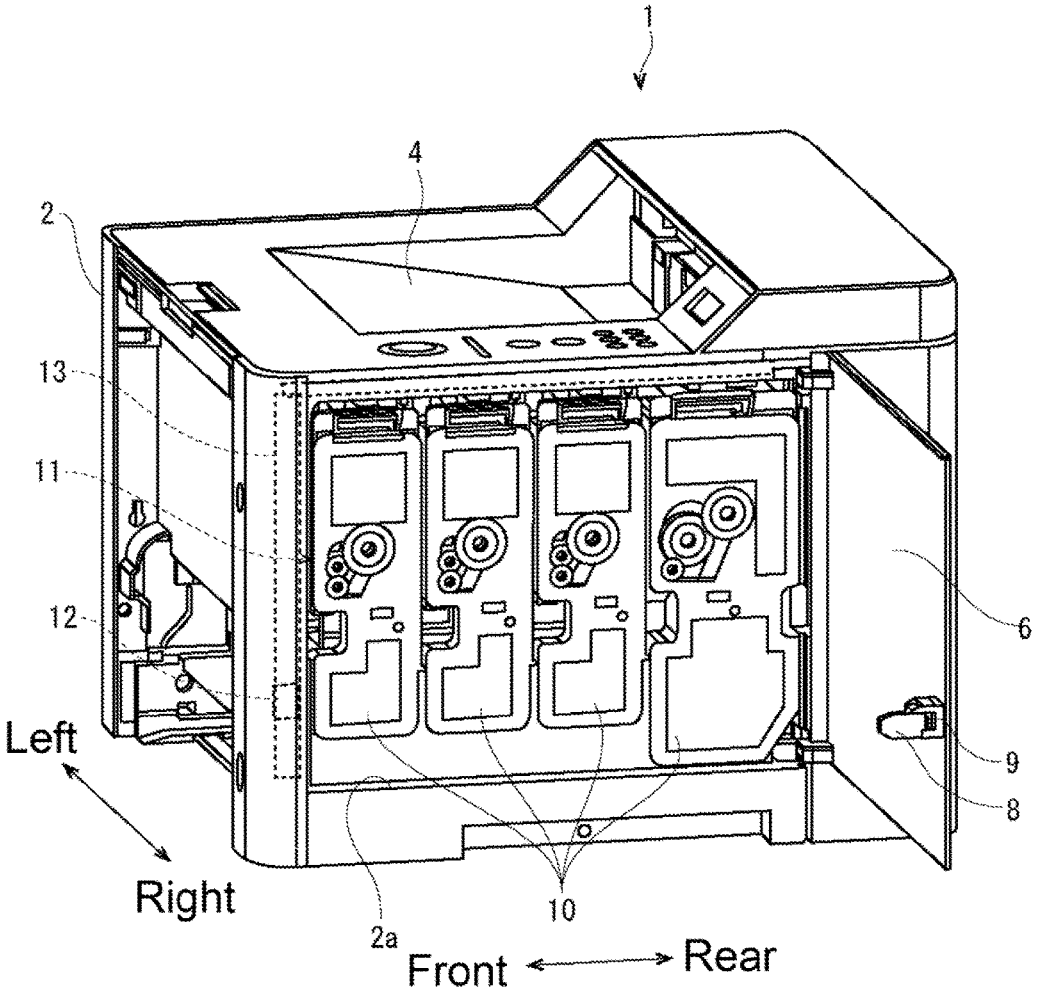
FIG. 2 obliquely illustrates a state where a toner-container-attaching/removing opening is open, at the color printer according to the one embodiment.

As illustrated in FIG. 2, the apparatus main body 2 has a right-side surface where a toner-container-attaching/removing opening 2*a* having a horizontally long rectangular shape is formed. The toner-container-attaching/removing opening 2*a* is openable/closable by a cover 6. The cover 6 turns around turning shafts located at a rear upper corner and a rear lower corner of the toner-container-attaching/removing opening 2*a*. As illustrated in FIG. 3, the cover 6 has an internal surface where a pressing piece 8 is secured by a bracket 9 on a part slightly inside from a front edge. The pressing piece 8 has a rectangular parallelepiped shape flattened in a lateral direction. The pressing piece 8 has respective corners where tapered surfaces are formed.

A toner container mounting portion 11, a detecting device 12, and a switching member 13 are included inside the toner-container-attaching/removing opening 2*a*. Toner containers 10 where toners of respective colors are housed are removably mounted on the toner container mounting portion 11. The detecting device 12 includes a switch 12*a* that can be switched by the presence or absence of mounting of the toner containers 10. The switching member 13 moves in conjunction with an opening/closing operation of the cover 6 to switch the switch 12*a* of the detecting device 12.

Figure 4A:
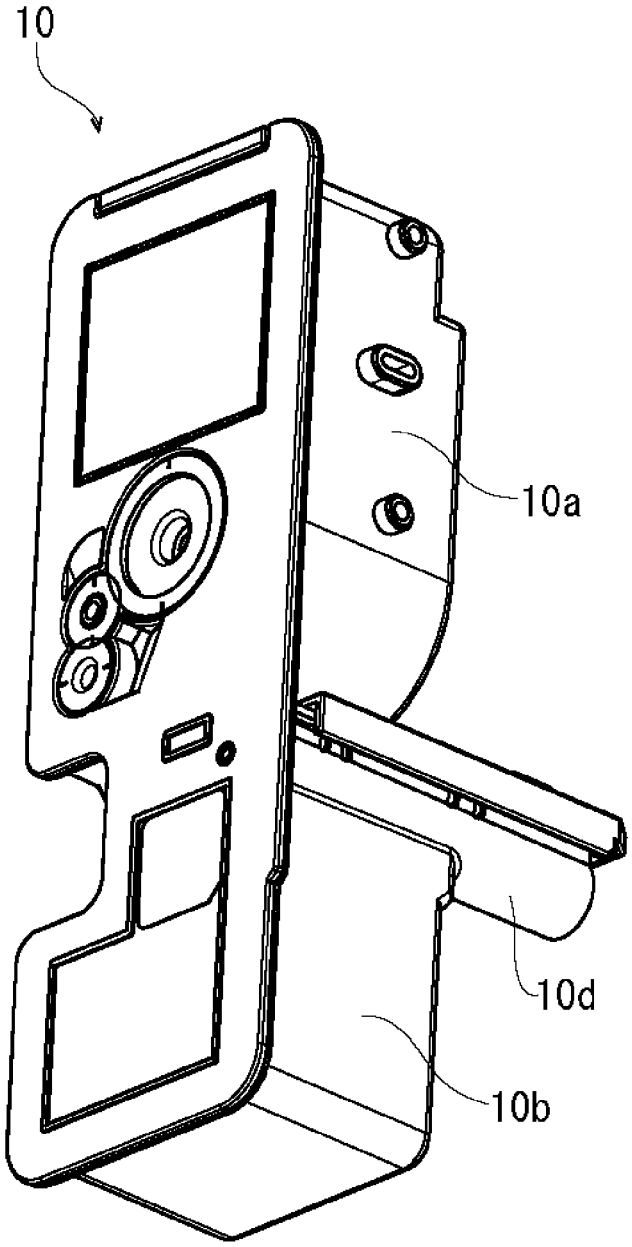
FIGS. 4A and 4B illustrate a toner container, at the color printer according to the one embodiment.
Figure 4B:
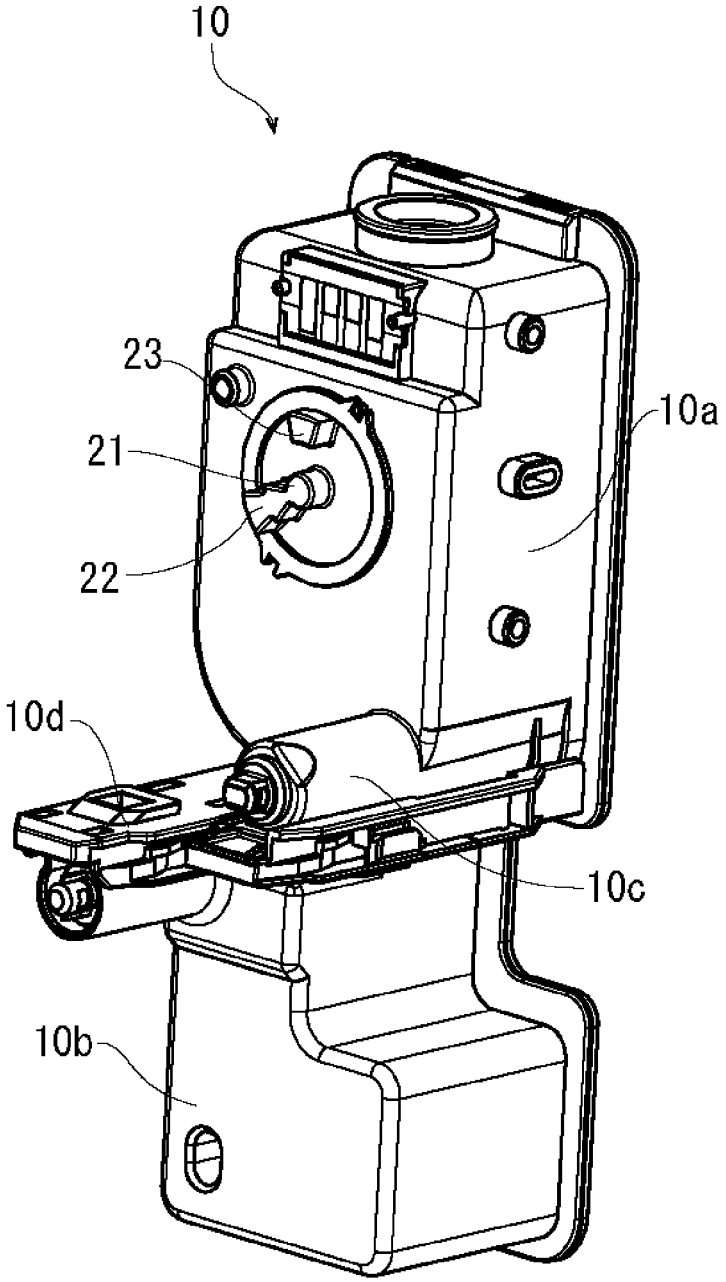

First, the following describes the toner container 10 with reference to FIGS. 4A and 4B. FIG. 4A is a perspective view where a toner container is viewed from a front side. FIG. 4B is a perspective view where the toner container is viewed from a back side.

The toner container 10 includes an upper toner housing portion 10*a* and a lower toner recovering portion 10*b*. The upper toner housing portion 10*a* has a vertically elongate approximately rectangular parallelepiped shape. The toner supplied to the image forming unit is housed in the upper toner housing portion 10*a*. A waste toner generated at the image forming unit is recovered into the lower toner recovering portion 10*b*. The toner housing portion 10*a* has a back surface where a toner replenishment duct 10*c* is located to protrude. The toner is supplied to the image forming unit through this toner replenishment duct 10*c*. The toner recovering portion 10*b* has a back surface where a toner recovering duct 10*d* is located to protrude. The waste toner is recovered from the image forming unit through this toner recovering duct 10*d*.

A cylindrically-shaped boss 21, and a first engaging protrusion 22 and a second engaging protrusion 23 are located to protrude at the back surface of the toner housing portion 10*a*. The first engaging protrusion 22 and the second engaging protrusion 23 are incompatible shaped portions located by types of the toner container 10 in order to determine a type of the toner container 10. The first engaging protrusion 22 is formed to project from the boss 21 in a radial direction. The second engaging protrusion 23 is formed separating from the boss 21. The first engaging protrusion 22 has an approximately fan shape in plan view, in detail, a shape where two fan-shaped portions centering the boss 21 are aligned along the radial direction of the boss 21. The fan-shaped portion has a center angle with about 45°. The second engaging protrusion 23 has a fan shape in plan view centering the boss 21. The second engaging protrusion 23 has a center angle with about 45°.

Figure 5A:
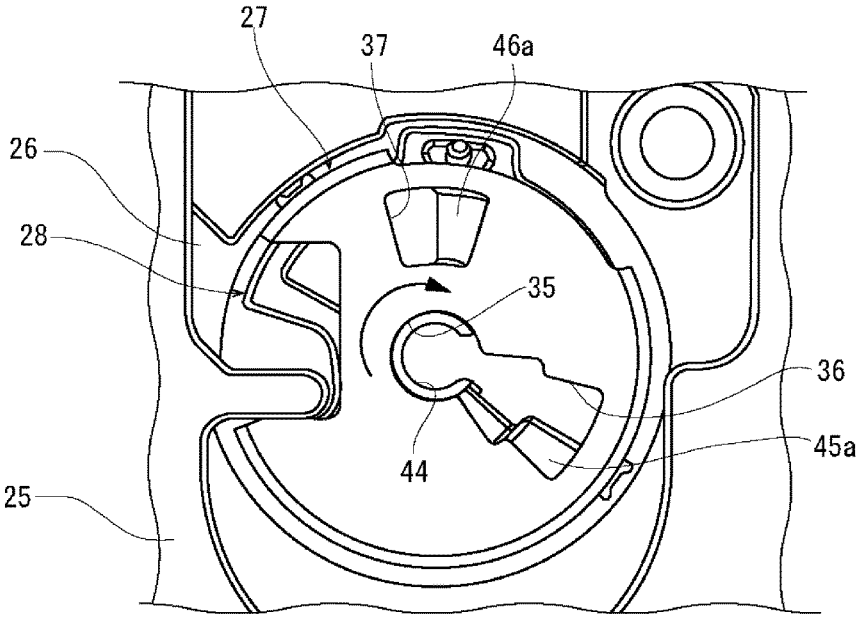
FIGS. 5A and 5B illustrate a container engaging portion of a toner container mounting portion, at the color printer according to the one embodiment.
Figure 5B:
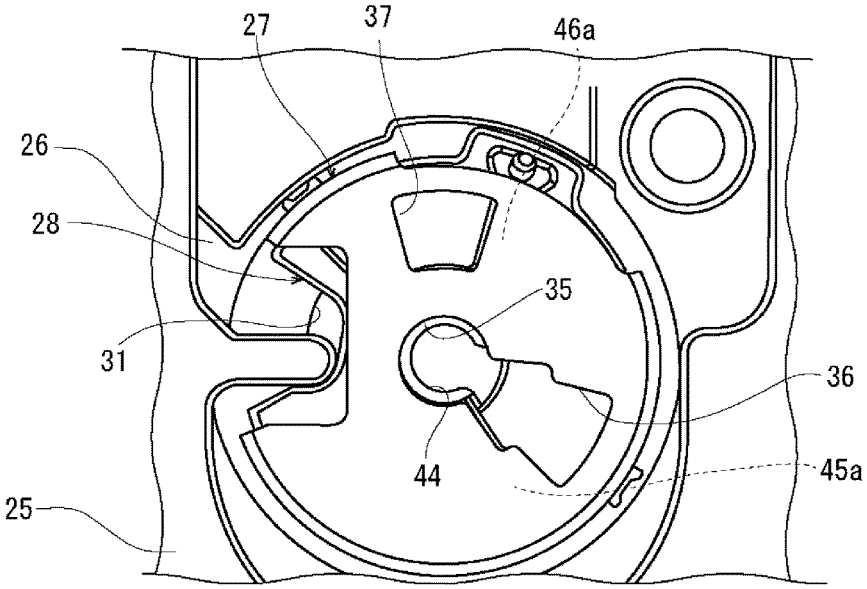
Figure 6:
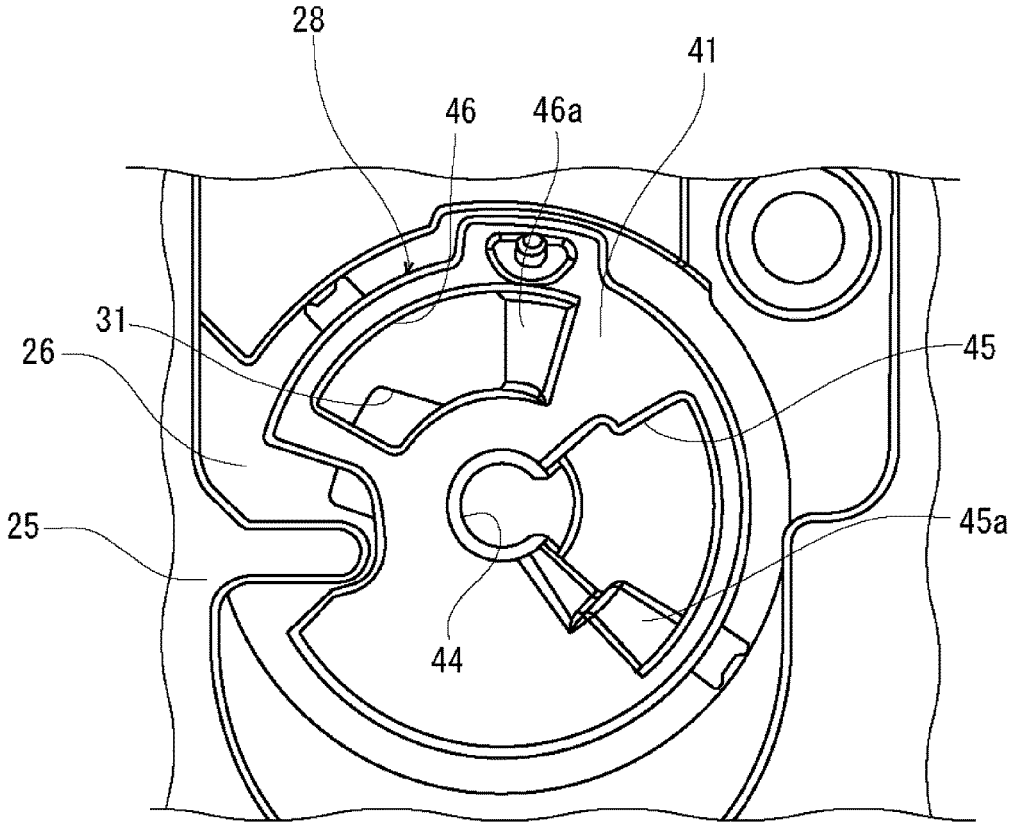
FIG. 6 illustrates the regulating member of the toner container mounting portion, at the color printer according to the one embodiment.
Figure 7:
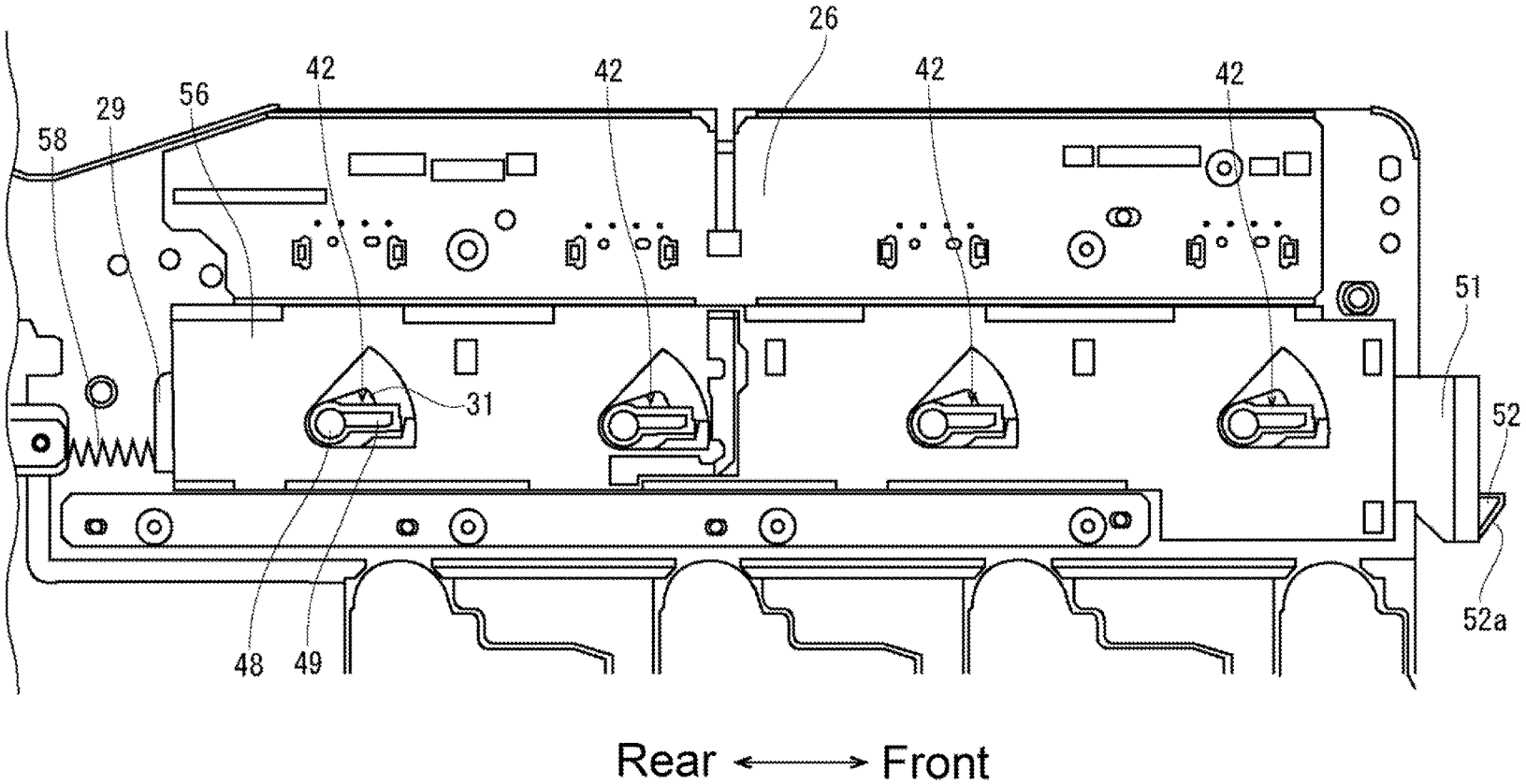
FIG. 7 illustrates a back surface of a plate cover of the toner container mounting portion, at the color printer according to the one embodiment.
Figure 8:
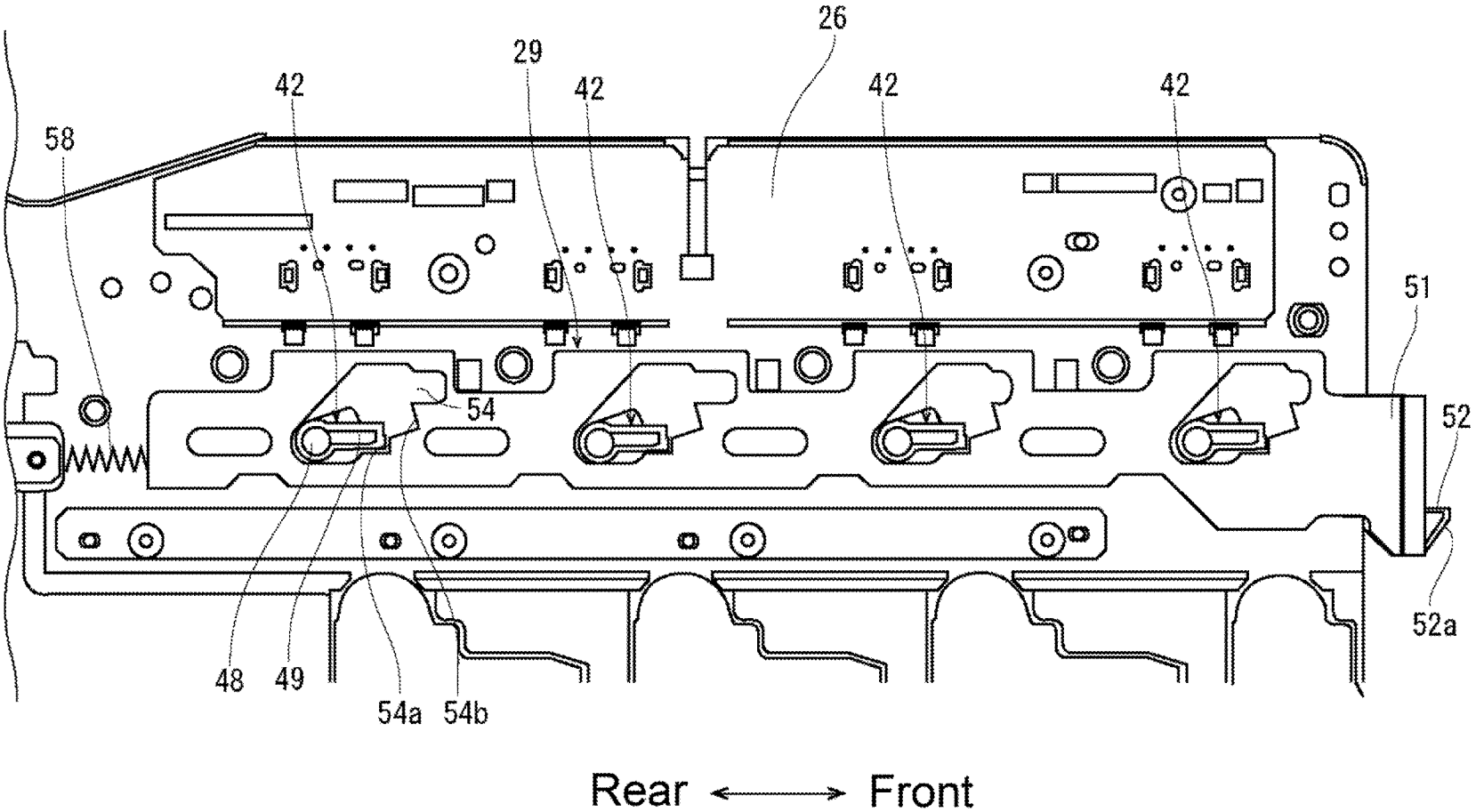
FIG. 8 illustrates a movable bar of the toner container mounting portion, at the color printer according to the one embodiment.

Next, the following describes the toner container mounting portion 11 with reference to FIG. 3 and FIGS. 5A to 8. FIGS. 5A and 5B illustrate a plate cover. FIG. 6 illustrates a regulating member. FIG. 7 illustrates a back surface of the plate cover. FIG. 8 illustrates a movable bar.

The toner container mounting portion 11 includes container holders 25, a support plate 26, a plate cover 27, a regulating member 28, and a movable bar 29. The container holders 25 are located by the toner containers 10 to be located side by side in the front-rear direction. The support plate 26 is located at a far-side (a left side) of the container holders 25. The plate cover 27 is supported by the support plate 26 to operate as an incompatible detecting portion that detects an incompatibility of the toner container 10 (see FIGS. 5A and 5B). The regulating member 28 is turnably supported between the support plate 26 and the plate cover 27 (see FIGS. 5B and 6). The movable bar 29 is supported slidably in the front-rear direction by a far-side surface (a left side surface) of the support plate 26 (see FIGS. 7 and 8).

The container holder 25 is a member having a concave portion that holds the toner container 10. The container holder 25, which is supported movably in a vertical direction, moves upward if the toner container 10 is mounted on the container holder 25.

The support plate 26 is a plate-shaped member. Multangular-shaped openings 31 are formed near the center in the vertical direction of the support plate 26 corresponding to the respective container holders 25.

As illustrated in FIGS. 5A and 5B, the plate cover 27 is a circular dish-shaped member. A circular opening 35 is formed at the center of the plate cover 27. Furthermore, a first engaging hole 36 and a second engaging hole 37 are formed at the plate cover 27. The first engaging hole 36 and the second engaging hole 37 are formed engageable with the first engaging protrusion 22 and the second engaging protrusion 23 (see FIGS. 4A and 4B) formed at the toner container 10 respectively. The plate cover 27 has an outer periphery portion secured by a peripheral area of the opening 31. A hollow portion is formed between the plate cover 27 and the support plate 26.

As illustrated in FIG. 6, the regulating member 28 includes an approximately disk-shaped main unit 41 and a regulating piece 42 (see FIGS. 7 and 8) formed at one surface of the main unit 41. The main unit 41 has a center where a circular opening 44 is formed. Furthermore, a first opening 45 and a second opening 46 are formed at the main unit 41.

The first opening 45 is formed with communicating with a part of a peripheral edge of the opening 44, and has an approximately fan shape. In detail, the first opening 45 has a shape where two fan-shaped portions centering the opening 44 are aligned along a radial direction of the opening 44. The fan-shaped portion has a center angle with about 90°. The center angle of the fan-shaped portion is formed greater than a center angle of the fan-shaped portion of the first engaging protrusion 22 formed at the toner container 10. An inclined surface 45*a*, which inclines in a far side direction, is formed at one side edge in a circumferential direction of the opening 44, at the first opening 45. The second opening 46 is formed at a position separating from the opening 44, and has a fan shape centering the opening 44. The second opening 46 has a center angle with about 90°. The center angle of the second opening 46 is formed greater than the center angle of the second engaging protrusion 23 formed at the toner container 10. An inclined surface 46*a*, which inclines in a far side direction is formed at one side edge in the circumferential direction of the opening 44, at the second opening 46.

As illustrated in FIGS. 7 and 8, the regulating piece 42 includes a shaft portion 48 and a projection piece portion 49. The shaft portion 48 is located to protrude coaxially with the opening 44 formed at the main unit 41. The projection piece portion 49 projects in a radial direction from a side surface of the shaft portion 48. The regulating piece 42 is formed to be configured to insert into the opening 31 formed at the support plate 26.

At the regulating member 28, the main unit 41 is supported by the hollow portion between the support plate 26 and the plate cover 27, and the regulating piece 42 projects inside from the opening 31 formed at the support plate 26. The main unit 41 is positioned such that the opening 44 is coaxially with the opening 35 of the plate cover 27. Then, the main unit 41 is turnably supported by the support plate 26 centering the opening 44. And as illustrated in FIG. 5A, the main unit 41 is biased in the anticlockwise direction in FIG. 6 by a biasing member (not illustrated) such that the inclined surface 45*a* of the first opening 45 is exposed from the first engaging hole 36, and the inclined surface 46*a* of the second opening 46 is exposed from the second engaging hole 37. As illustrated in FIG. 7, the projection piece portion 49 of the regulating piece 42 takes a horizontal posture extending approximately horizontally forward.

The regulating member 28 turns in the clockwise direction in FIG. 5A from an initial position centering the opening 44 against the biasing force of the biasing member when the first inclined surface 45*a* or the second inclined surface 46*a* of the main unit 41 is pressed. And as illustrated in FIG. 5B, the inclined surface 45*a* of the first opening 45 evacuates from the first engaging hole 36, and the inclined surface 46*a* of the second opening 46 evacuates to a turned position from the second engaging hole 37. Furthermore, the projection piece portion 49 of the regulating piece 42 changes its posture from the horizontal posture to an inclined posture inclined in an obliquely forward and upward direction.

As illustrated in FIGS. 7 and 8, the movable bar 29 is a plate-shaped member having a horizontally long rectangular shape. The movable bar 29 has a front-end edge where a lever piece 51 is located to extend therefrom. The lever piece 51 has a front surface where a pressing portion 52 is located to protrude. An inclined surface 52*a* inclined forward and obliquely downward is formed at the pressing portion 52.

Furthermore, openings 54 are formed at the movable bar 29. The openings 54 expose the regulating pieces 42, which project from the openings 31 of the support plate 26, of the respective regulating members 28. A regulating edge 54*a* and an escaping edge 54*b* are formed at the opening 54. The regulating edge 54*a* is opposed to a distal end edge of the projection piece portion 49 of the regulating piece 42 in the horizontal posture. The escaping edge 54*b* is formed having a predetermined space with respect to the distal end edge of the projection piece portion 49 in the inclined posture.

The movable bar 29 is supported slidably in a front-rear direction with respect to the support plate 26 by a guide plate 56. The movable bar 29 is biased forward by a biasing member 58. In a state where the distal end edge of the projection piece portion 49 of the regulating piece 42 is opposed to the regulating edge 54*a* of the opening 54, if the movable bar 29 attempts to slide rearward, the regulating edge 54*a* abuts on the distal end edge of the projection piece portion 49 to regulate the rearward slide of the movable bar 29. On the other hand, in a state where the distal end edge of the projection piece portion 49 of the regulating piece 42 is opposed to the escaping edge 54*b* of the opening 54, the abutment between the distal end edge of the projection piece portion 49 and the regulating edge 54*a* is released to permit the movable bar 29 to slide rearward against the biasing member.

Figure 3:
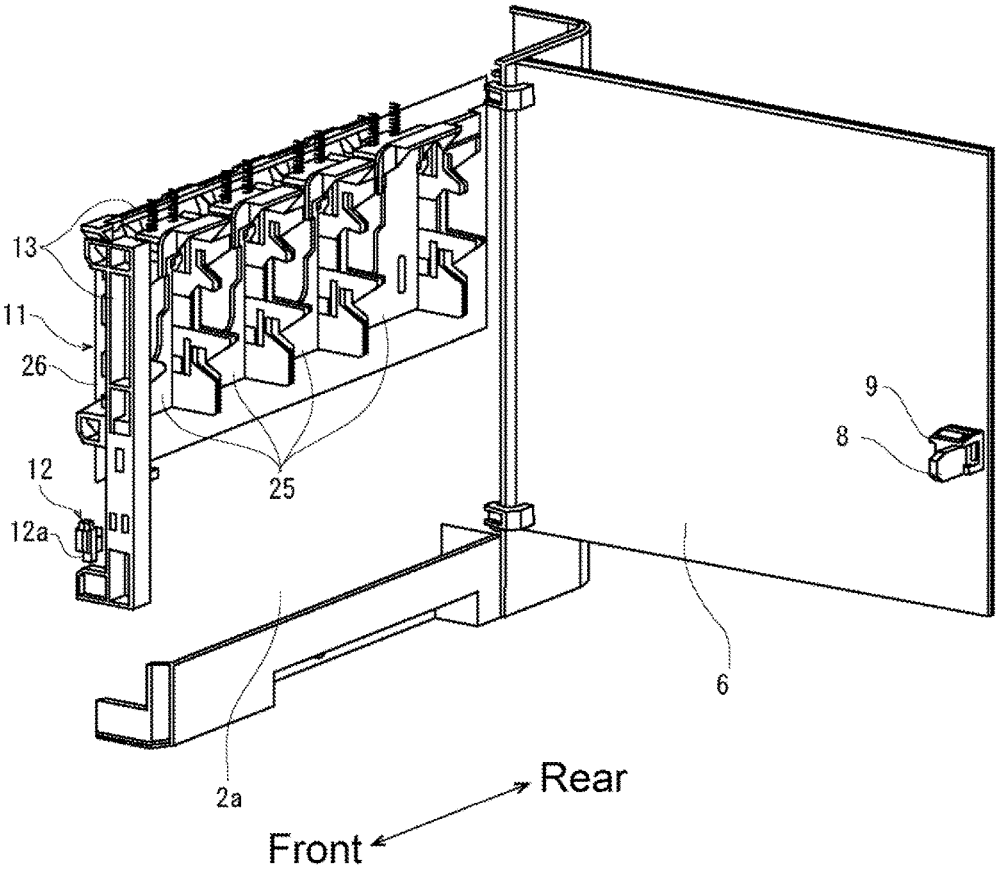
FIG. 3 obliquely illustrates the toner-container-attaching/removing opening, at the color printer according to the one embodiment.
Figure 9A:
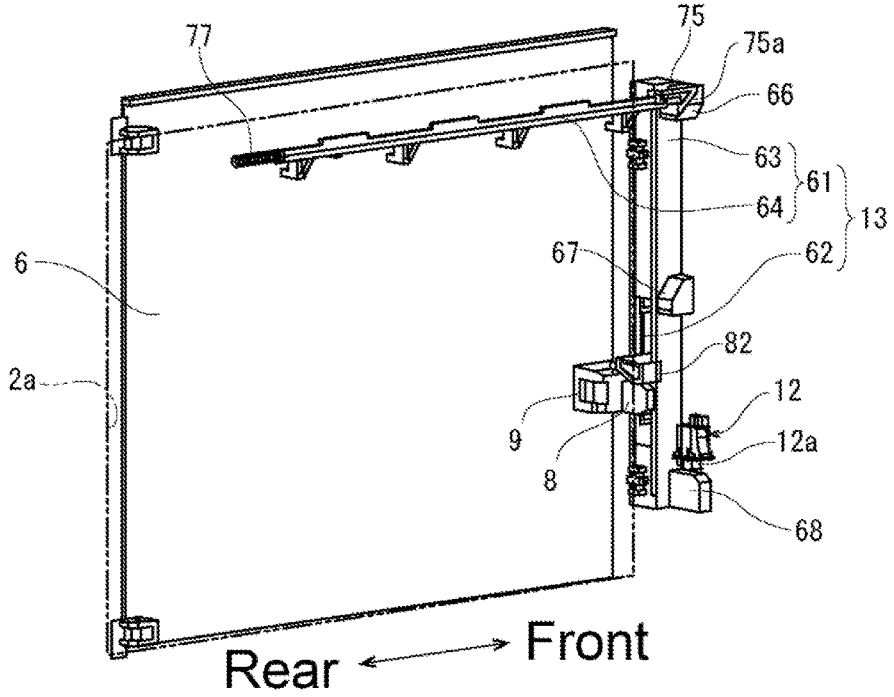
FIGS. 9A and 9B illustrate a switching member, at the color printer according to the one embodiment.
Figure 9B:
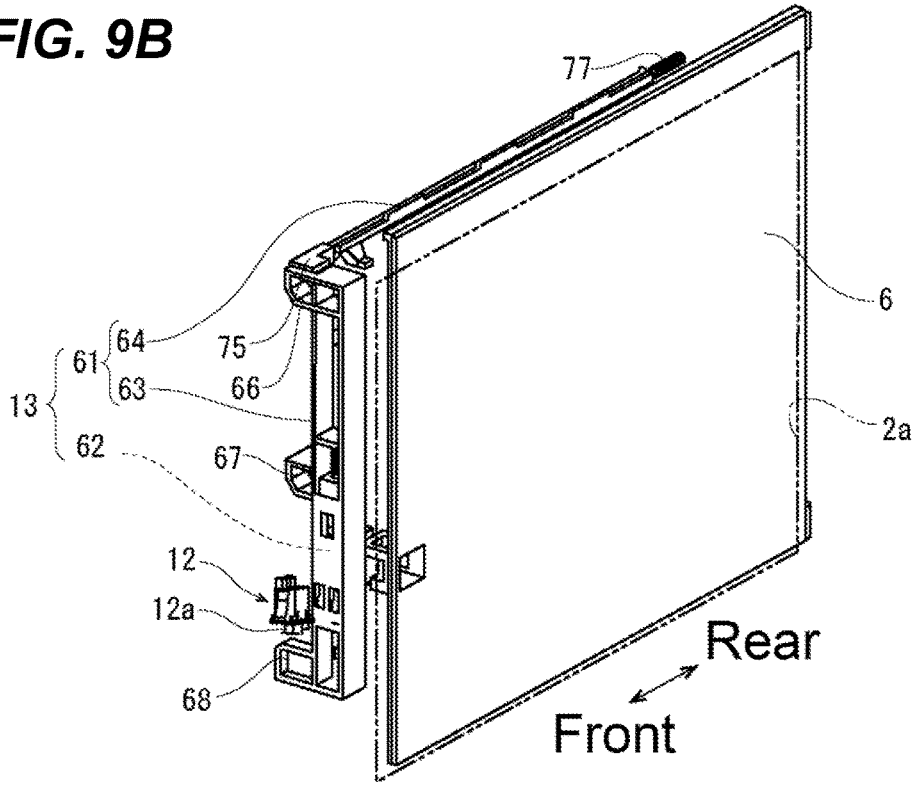

The detecting device 12 is, for example, a push-type sensor, and includes the switch 12*a* projecting downward as illustrated in FIGS. 3, 9A, and 9B. The switch 12*a* is switched to a first position where a mounting state of the toner container 10 is detected, by being pushed, and switched to a second position where an unmounting state of the toner container 10 is detected, by being released from pushed state. The detecting device 12 is electrically connected to the control unit. The control unit determines being an image formation possible state when the switch to the first position is transmitted to the control unit, and the control unit determines being an image formation impossible state when the switch to the second position is transmitted to the control unit.

As illustrated in FIGS. 2 and 3, the detecting device 12 is installed slightly above a lower-front corner of the toner-container-attaching/removing opening 2*a*.

Figure 10A:
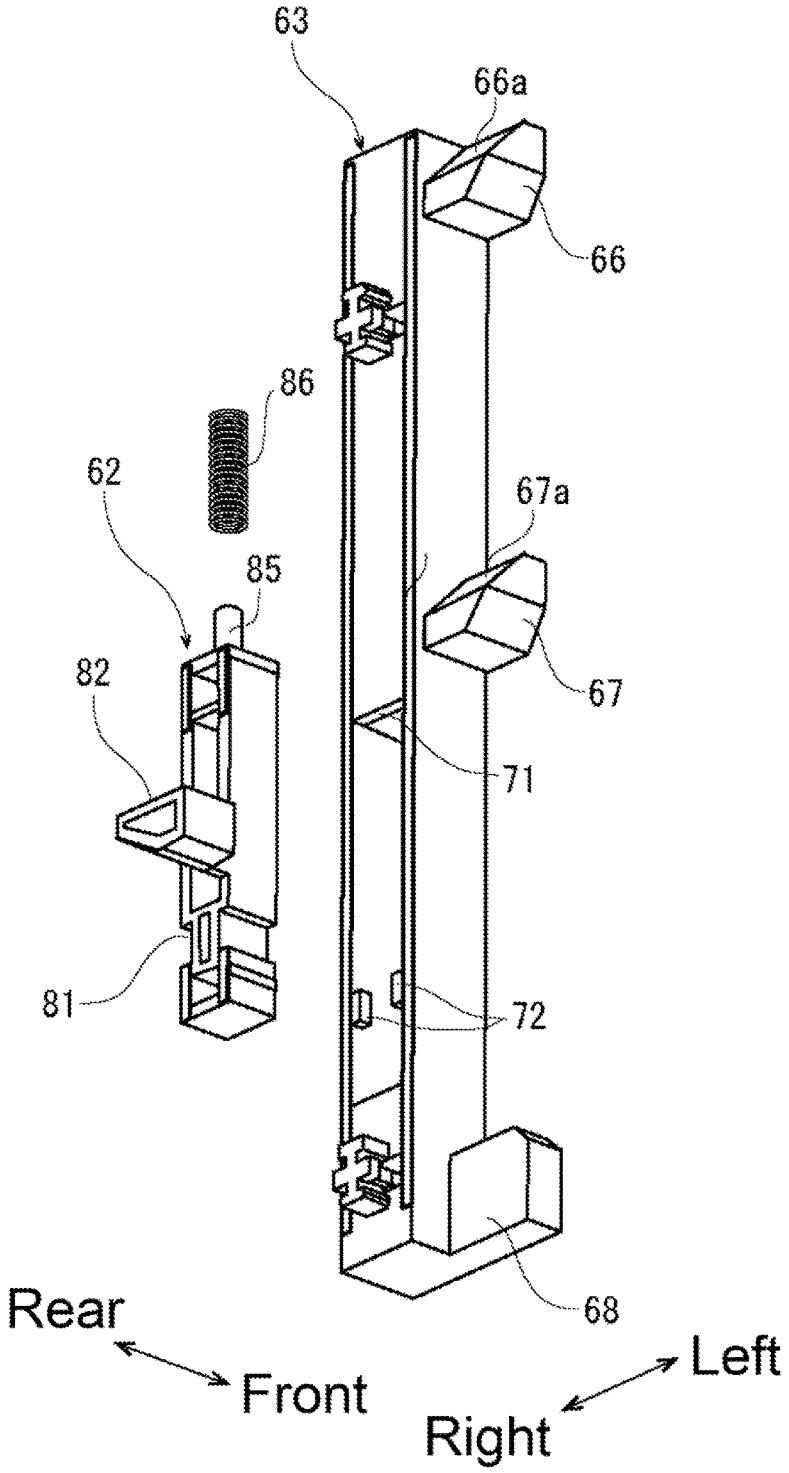
FIGS. 10A and 10B illustrate a vertical slide member of a first switching member, and a second switching member, at the color printer according to the one embodiment.
Figure 10B:
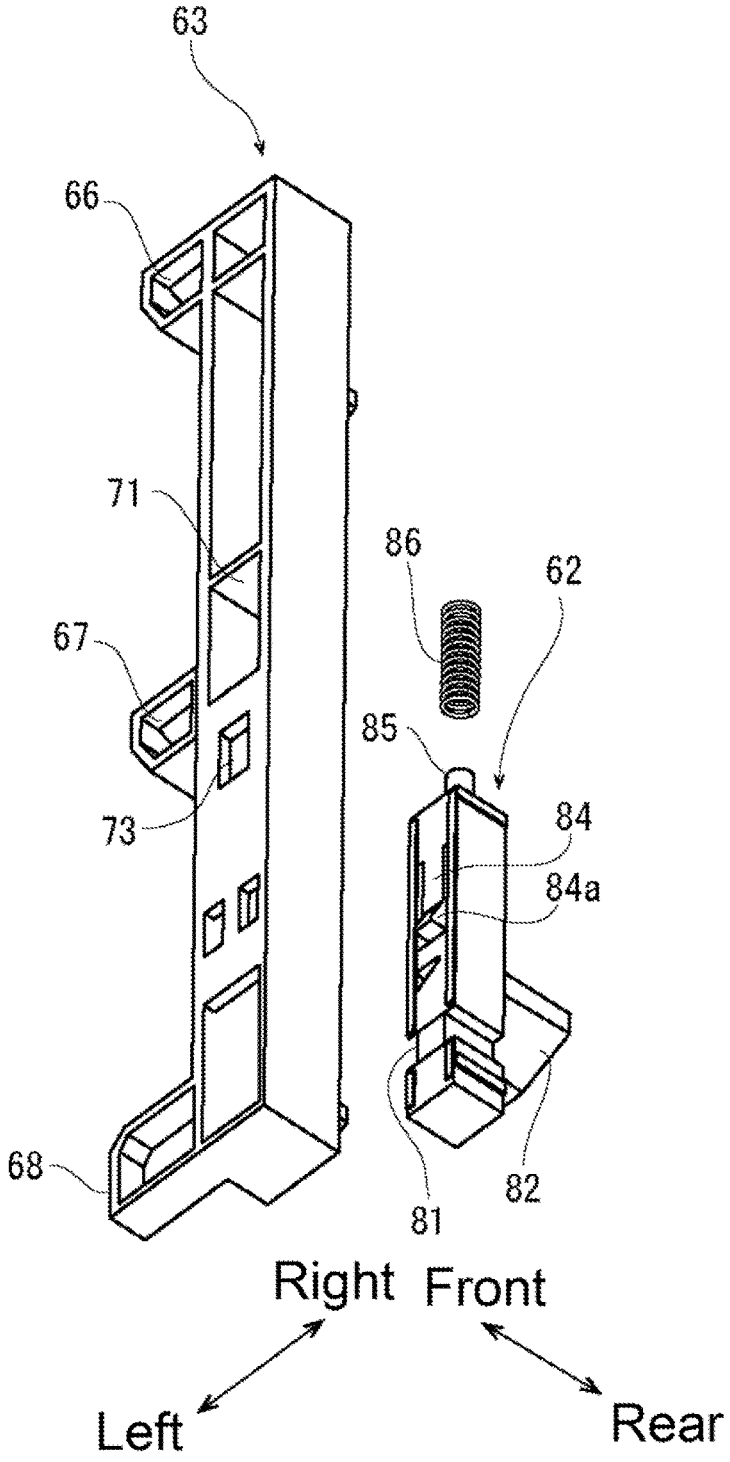

The following describes the switching member 13 with reference to FIGS. 9A, 9B, 10A, and 10B. FIGS. 9A and 9B obliquely illustrate a switching member. FIGS. 10A and 10B obliquely illustrate a decomposed first switching member. The switching member 13 includes a first switching member 61 and a second switching member 62. The first switching member 61 slides in a direction switching the switch 12*a* of the detecting device 12 to the first position and the second position. The second switching member 62 is slidably supported with respect to the first switching member 61, and operates simultaneously with the opening/closing operation of the cover 6.

As illustrated in FIGS. 9A and 9B, the first switching member 61 includes a vertical slide member 63 and a horizontal slide member 64. The vertical slide member 63 is supported slidably in a vertical direction along a front edge of the toner-container-attaching/removing opening 2*a*. The horizontal slide member 64 is supported slidably in a lateral direction along an upper edge of the toner-container-attaching/removing opening 2*a*.

The vertical slide member 63 is a hollow square-cylindrical member, which is long in the vertical direction. The vertical slide member 63 has a left side surface where an upper pressing portion 66, a central pressing portion 67, and a lower pressing portion 68 are located to protrude at an upper end portion, a central portion, and a lower end portion respectively. The upper pressing portion 66 has a rear surface where an inclined surface 66*a* inclined obliquely rearward and upward is formed. The central pressing portion 67 has a rear surface where an inclined surface 67*a* inclined obliquely rearward and upward is formed. The lower pressing portion 68 has a rectangular parallelepiped shape, which is flat in the lateral direction, and has an upper corner where a tapered surface is formed.

As illustrated in FIG. 10A, the hollow portion of the vertical slide member 63 is divided into an upper portion and a lower portion by a partition wall 71. The lower hollow portion has a rear surface that is opened. A pair of projection pieces 72 projecting to the lower hollow portion are formed at both side edges of the opening. As illustrated in FIG. 10B, an opening 73 is formed at a front surface of the vertical slide member 63 at a front side of the lower hollow portion.

As illustrated in FIGS. 9A and 9B, the horizontal slide member 64 is a plate piece, which is long in a front-rear direction. The horizontal slide member 64 has a front end where a front pressing portion 75 is formed. An inclined surface 75*a* inclined obliquely forward and downward is formed at the front pressing portion 75. The horizontal slide member 64 is biased in the forward direction by a coil spring 77 as a second biasing member.

As illustrated in FIGS. 10A and 10B, the second switching member 62 is a square-cylindrical member shorter than a height of the lower hollow portion of the vertical slide member 63. A narrow width portion 81 which width in a lateral direction is narrow is formed at a lowered position of the second switching member 62. Furthermore, a pressed portion 82 is located to protrude at a center of a rear side surface of the second switching member 62. Furthermore, an elastic piece 84 that elastically deforms centering an upper end is formed at an upper portion of a front surface of the second switching member 62. A tapered claw 84*a* is formed at a distal end of a front surface of the elastic piece 84. Furthermore, a pin 85 is located upright at a top surface of the second switching member 62.

The second switching member 62 is slidably housed in the lower hollow portion of the vertical slide member 63. When housing the second switching member 62 in the lower hollow portion, the narrow width portion 81 of the second switching member 62 is passed between the pair of projection pieces 72, and the claw 84*a* of the elastic piece 84 of the second switching member 62 is engaged with the opening 73 of the vertical slide member 63. Thus, the second switching member 62 slides in the vertical direction in the lower hollow portion. Dropout from the lower hollow portion of the second switching member 62 is prevented by the pair of projection pieces 72.

A coil spring 86 as a first biasing member, which is freely fit to the pin 85, is interposed between the second switching member 62 and the partition wall 71. The coil spring 86 biases the second switching member 62 downward. The biasing force of the coil spring 86 is set greater than the biasing force of the coil spring 77 that biases the horizontal slide member 64 forward.

Figure 11:
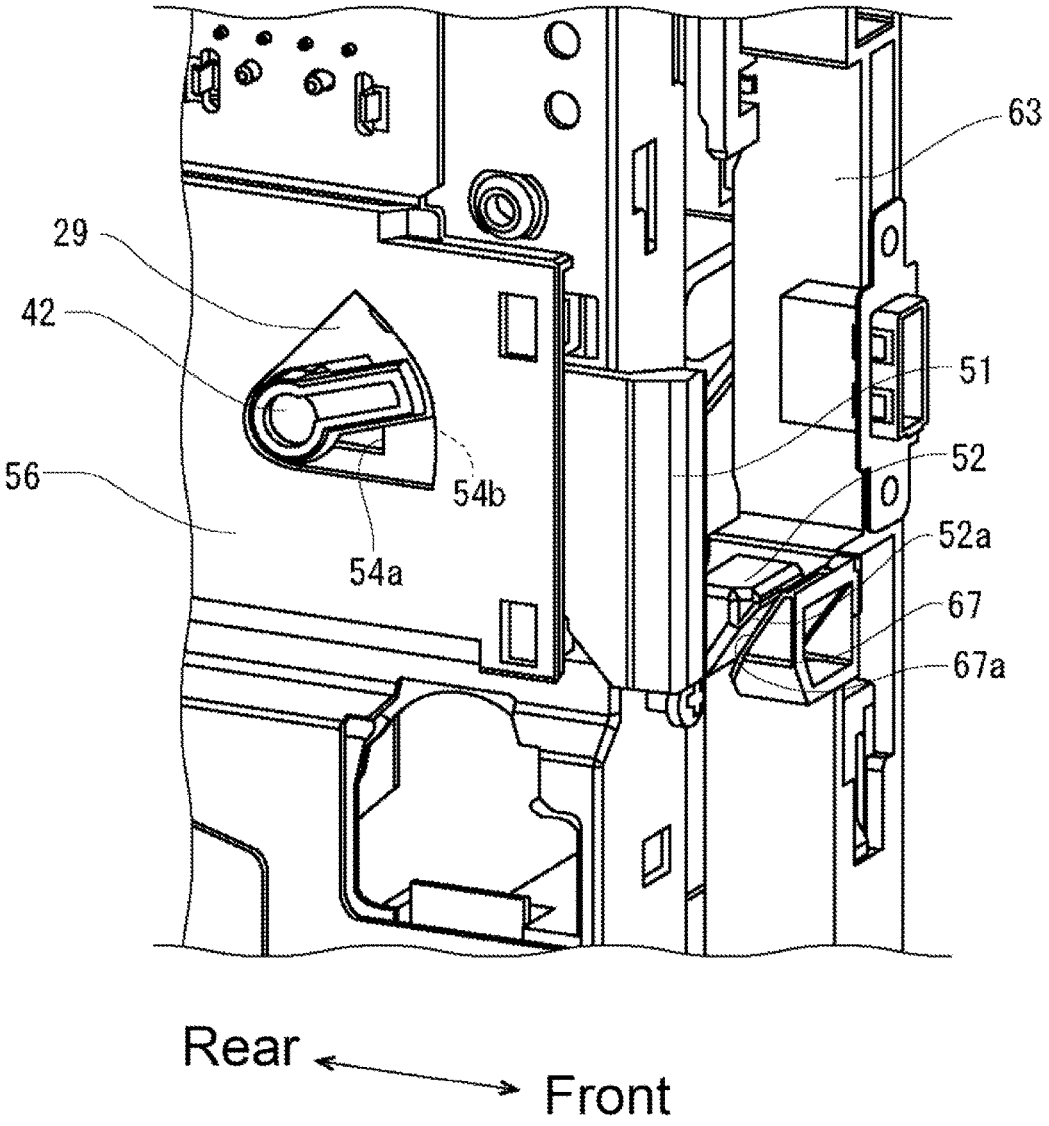
FIG. 11 obliquely illustrates the vertical slide member and the movable bar, at the color printer according to the one embodiment.

As described above, the vertical slide member 63 is supported slidably in the vertical direction along the front edge of the toner-container-attaching/removing opening 2*a*, and the horizontal slide member 64 is supported slidably in the front-rear direction along the upper edge of the toner-container-attaching/removing opening 2*a*. Then, the inclined surface 66*a* of the upper pressing portion 66 of the vertical slide member 63 abuts on the inclined surface 75*a* of the front pressing portion 75 of the horizontal slide member 64. As illustrated in FIG. 11 (described later), the inclined surface 67*a* of the central pressing portion 67 abuts on the inclined surface 52*a* of the pressing portion 52 of the movable bar 29. Furthermore, the lower pressing portion 68 of the vertical slide member 63 is opposed to a lower side of the switch 12*a* of the detecting device 12.

Figure 12:
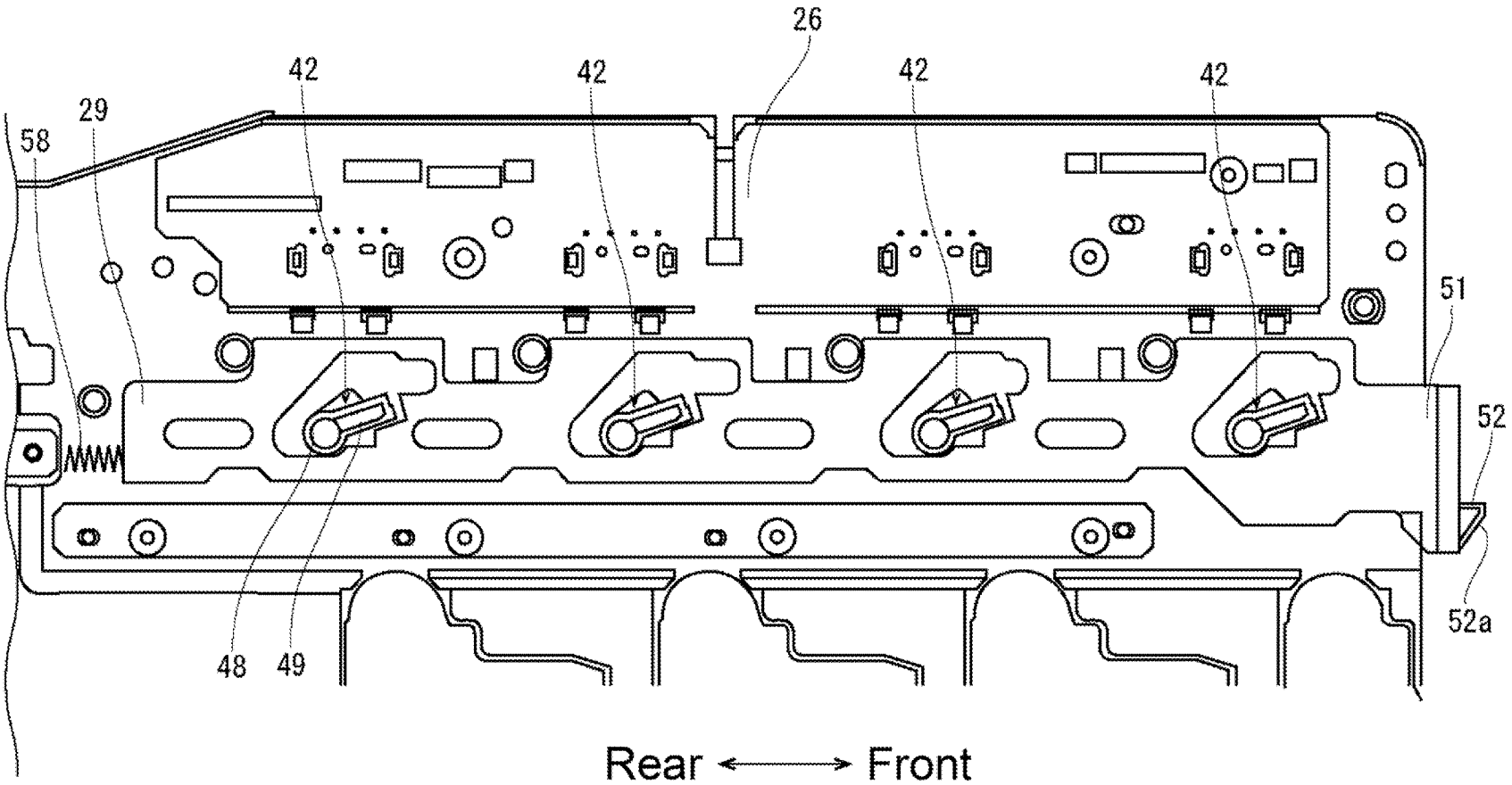
FIG. 12 illustrates the movable bar slid to a forward direction, at the color printer according to the one embodiment.

At the color printer 1 having the above-described configuration, the following describes an operation that detects the mounting state and the unmounting state of the toner container 10 on the toner container mounting portion 11, by the detecting device 12 with reference to FIGS. 5A, 5B, and 8 to 12. FIG. 11 obliquely illustrates a pressing portion 52 of a movable bar 29 and a central pressing portion 67 of a vertical slide member 63. FIG. 12 illustrates a state where a movable bar 29 has slid.

When the toner container 10 is not mounted on the toner container mounting portion 11, as illustrated in FIG. 5A, at the regulating member 28, the inclined surface 45*a* of the first opening 45 of the main unit 41 is exposed from the first engaging hole 36, and the inclined surface 46*a* of the second opening 46 is exposed from the second engaging hole 37. As illustrated in FIG. 8, the projection piece portion 49 of the regulating piece 42 takes the horizontal posture extending forward approximately horizontally, and the distal end edge of the projection piece portion 49 is opposed to the regulating edge 54*a* of the opening 54 of the movable bar 29. This regulates the slide in the rear direction of the movable bar 29.

The inclined surface 52*a* of the pressing portion 52 of the movable bar 29 abuts on the inclined surface 67*a* of the central pressing portion 67 of the vertical slide member 63. As described above, since the slide in the rear direction of the movable bar 29 is regulated, the slide in an upward direction of the vertical slide member 63 is regulated. That is, the slide in a direction pushing the switch 12*a* of the detecting device 12, that is, the switch of the detecting device 12 from the second state to the first state is regulated.

When mounting the toner container 10 on the toner container mounting portion 11, first, the toner container 10 is held by the container holder 25 to be pushed in the left direction, and then the boss 21 formed at a back surface of the toner container 10 is inserted into the opening 44 of the regulating member 28 through the opening 35 of the plate cover 27. Simultaneously, the first engaging protrusion 22 and the second engaging protrusion 23 of the toner container 10 are engaged with the first engaging hole 36 and the second engaging hole 37 of the plate cover 27 respectively to abut on the inclined surface 45*a* and the inclined surface 46*a* of the regulating member 28 respectively. If the toner container 10 is further pushed, the first engaging protrusion 22 and the second engaging protrusion 23 press the inclined surfaces 45*a* and 46*a* respectively. Then, the regulating member 28 turns in the clockwise direction in FIG. 5B against the biasing force of the biasing member. The first engaging protrusion 22 and the second engaging protrusion 23 are inserted into the first engaging hole 36 and the second engaging hole 37 respectively. This normally mounts the toner container 10 on the toner container mounting portion 11.

If the regulating member 28 turns to the turned position, as illustrated in FIG. 12, the projection piece portion 49 of the regulating piece 42 changes its posture from the horizontal posture to the inclined posture, and the distal end edge of the projection piece portion 49 is opposed to the escaping edge 54*b* of opening 54 to release the abutting on the regulating edge 54*a*. This permits the slide in the rear direction of the movable bar 29 against the biasing member 58.

Since the first engaging protrusions 22 and the second engaging protrusions 23 formed at the toner containers 10 are of form configured according to the types of the toner containers 10, when attempting to mount an incompatible toner container on the toner container mounting portion 11, an engaging protrusion formed at this toner container is not engaged with the first engaging hole 36 and the second engaging hole 37 formed at the plate cover 27. That is, since the regulating member 28 does not turn, that is, is at the initial position, the slide in the rear direction of the movable bar 29 remains to be regulated.

Next, if the cover 6 is closed, the pressing piece 8 located at the cover 6 abuts on the pressed portion 82 of the second switching member 62 housed in the vertical slide member 63. Then, the pressed portion 82 is pressed upward, and then force in the upward direction is also applied to the vertical slide member 63 where the second switching member 62 is housed. Then, force in the rear direction is applied to the inclined surface 75*a* of the front pressing portion 75 of the horizontal slide member 64 abutted by the inclined surface 66*a* of the upper pressing portion 66 of the vertical slide member 63.

Since the biasing force of the coil spring 86, which biases the second switching member 62, is greater than the biasing force of the coil spring 77, which biases the horizontal slide member 64 in the forward direction, when the pressed portion 82 of the second switching member 62 is pressed upward by the pressing piece 8 of the cover 6, the coil spring 86, which biases the pressed portion 82, is not compressed, and the coil spring 77, which biases the horizontal slide member 64, is preferentially compressed. Accordingly, this ensures the slide in the rear direction of the horizontal slide member 64, and the upward side of the vertical slide member 63 with the second switching member 62.

On the other hand, since the movable bar 29 is in a state where the slide in the rear direction is permitted, when the vertical slide member 63 slides upward to cause the inclined surface 67*a* of the central pressing portion 67 to press the inclined surface 52*a* of the pressing portion 52 of the movable bar 29, the movable bar 29 slides in the rear direction against the biasing force of the biasing member 58 as illustrated in FIG. 12. This slides the vertical slide member 63 in the upward direction to cause the lower pressing portion 68 to press the switch 12*a* of the detecting device 12, thus switching the detecting device 12 to the first position.

When any of the toner containers 10 is not mounted on the toner container mounting portion 11, the regulating member 28 corresponding to this toner container 10 does not turn to regulate the slide in the left direction of the movable bar 29. Thus, if the cover 6 is closed in a state where the toner container 10 is unmounted, as described above, the vertical slide member 63 attempts to slide upward with the second switching member 62. However, since the slide in the rear direction of the movable bar 29 is regulated, the abutment between the pressing portion 52 of the movable bar 29 and the central pressing portion 67 regulates the upward slide of the vertical slide member 63. Accordingly, the switch 12*a* of the detecting device 12 is not pushed to regulate the switch to the first position.

However, even when the upward slide of the vertical slide member 63 is regulated, since the pressed portion 82 of the second switching member 62 is pressed upward by the pressing piece 8 of the cover 6, the second switching member 62 slides in the upward direction relatively with respect to the vertical slide member 63 against the biasing force of the coil spring 86. Finally, the second switching member 62 slides in the upward direction until the cover 6 is completely closed.

Thus, when the toner container 10 is unmounted, even if the toner-container-attaching/removing opening 2*a* is closed by the cover 6, the detecting device 12 is not switched to the first position. That is, since information indicative of the unmounting state of the toner container 10 is transmitted from the detecting device 12 to the control unit, the control unit determines being in the image formation impossible state. Accordingly, the image forming operation is not performed.

As described above, the color printer 1 according to the embodiment of the disclosure ensure preventing the different type of toner container from being mounted on the toner container mounting portion 11. That is, the incompatibility of the toner container 10 can be detected. When the toner container 10 is halfway mounted, and when one of the toner containers 10 is not mounted on the toner container mounting portion 11, since the switch 12*a* of the detecting device 12 cannot be switched to the first state, the image forming unit does not perform the image formation operation. Accordingly, the image failure and the operation failure can be prevented.

Changing the first engaging protrusion 22 and the second engaging protrusion 23 per type of the toner container 10 ensures detecting the incompatibility of the toner container 10 by a simple configuration.

Furthermore, simple operations such that the toner container 10 is held by the container holder 25, and the first engaging protrusion 22 and the second engaging protrusion 23 are inserted into the first engaging hole 36 and the second engaging hole 37 of the plate cover 27 ensures detecting whether the toner container 10 is normally mounted on the toner container mounting portion 11.

Furthermore, even in a state where the toner container 10 is unmounted, the cover can be closed without switching the detecting device 12 to the first position. For example, when the color printer 1 needs to be conveyed in a state where the toner container 10 is unmounted for a maintenance or similar reason, in a case of a configuration that the cover 6 cannot be closed insofar as the toner container 10 is not mounted, the cover 6 remains open, thus making the convey difficult. However, in the embodiment, even if the toner container 10 is not mounted, the cover 6 can be closed without switching the detecting device 12 to the first position, thus facilitating the handling of the color printer 1.

Furthermore, in the embodiment of the disclosure, the case where the configuration of the disclosure is applied to the color printer 1 has been described. However, in other different embodiments, the configuration of the disclosure may be applied to an image forming apparatus such as a copier, a facsimile, and a multi-functional peripheral other than the color printer 1.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an image forming unit that forms an image using toner;

a mounting portion on which a toner container of a given type is removably mounted, the toner container and the mounting portion respectively including an engaging protrusion and an engaging hole, the engaging protrusion and the engaging hole being engageable with one another, and the engaging protrusion and the engaging hole being of form configured according to the toner container type, wherein the mounting portion includes a plate cover in which the engaging hole is formed, a regulating member supported by the plate cover, the engaging protrusion being engaged with the engaging hole causing the regulating member to be turnable in a predetermined direction from an initial position into a turned position, and a movable bar slidably supported by the plate cover to be restricted from sliding by abutment on the regulating member while the regulating member is at the initial position, and to be permitted to slide by release of the abutment through the regulating member being turned in the predetermined direction into the turned position; and a detecting device that detects whether or not the toner container has been mounted on the mounting portion, the engaging protrusion and the engaging hole being engaged with one another causing the detecting device to detect that the toner container has been mounted on the mounting portion, the detecting device including a switch switchable between a first position for detecting a mounting state where the toner container is mounted on the mounting portion, and a second position for detecting an unmounted state where the toner container is not mounted on the mounting portion; wherein the movable bar regulates the switching from the second position to the first position of the switch in the unmounting state of the toner container.

2. The image forming apparatus according to claim 1, further comprising:

a cover that opens and closes the mounting portion; and a switching member that switches the switching of the detecting device by moving in conjunction with the opening/closing operation of the cover; wherein the movable bar regulates the movement of the switching member in a direction in which the switching switches from the second position to the first position when the cover is closed in the unmounting state of the toner container.

3. The image forming apparatus according to claim 2, wherein:

the switching member further includes a first switching member that slides to switch the switch of the detecting device, a second switching member slidably supported by the first switching member to slide in conjunction with the opening/closing operation of the cover, a first biasing member interposed between the first switching member and the second switching member such that biasing force of the first biasing member acts in a direction opposite from a sliding direction of the second switching member in conjunction with the closing operation of the cover, and a second biasing member that biases the first switching member in a direction in which the switch of the detecting device switches from the first position to the second position; and the second biasing member is configured to have a biasing force greater than the biasing force of the first biasing member.

* * * * *